United States Patent [19]

Ohta et al.

[11] Patent Number: 4,868,353

[45] Date of Patent: Sep. 19, 1989

[54] MULTIPLE SWITCH ASSEMBLY WITH INTERLOCK AND LOCK RELEASE MEMBER

[75] Inventors: Takashi Ohta; Akira Suzuki, both of Aichi, Japan

[73] Assignee: Kabushiki Kaisha Tokai Denki Seisakusho, Aichi, Japan

[21] Appl. No.: 175,259

[22] Filed: Mar. 30, 1988

[30] Foreign Application Priority Data

Mar. 30, 1987 [JP] Japan ..... 62-079456

[51] Int. Cl.[4] ..... H01H 9/20

[52] U.S. Cl. ..... 200/5 B; 200/5 E

[58] Field of Search ..... 200/4.5 R, 5 B, 5 E, 200/5 EA, 5 EB, 50 C

[56] References Cited

U.S. PATENT DOCUMENTS 4,720,608 1/1988 Mizuta ..... 200/5 E X

*Primary Examiner*—J. R. Scott

*Attorney, Agent, or Firm*—Birch, Stewart, Kolasch & Birch

[57] ABSTRACT

A switch assembly for use, as example, for a wiper switch or an illumination switch of an automobile includes a plurality of switch units each having a control lever. The control lever of one of the switch units has a function of turning on the corresponding switch unit and, additionally, returning the control levers or contact holders of the switch units disposed at ON positions to OFF positions. The switch assembly eliminates the need for the provision of a special return lever or release lever for only returning the control levers or the contact holders from the ON positions to the OFF positions. Accordingly, this construction reduces the number of control levers, which makes the switch assembly small.

2 Claims, 3 Drawing Sheets

MULTIPLE SWITCH ASSEMBLY WITH INTERLOCK AND LOCK RELEASE MEMBER

BACKGROUND OF THE INVENTION

1. Field of the Invention

The present invention generally relates to a switch assembly, and more particularly, to a switch assembly which employs a plurality of switches or switch units and includes a lever for turning off all switches housed in a switch case.

2. Description of the related Art

Various constructions are known in this kind of switch assembly. The following is a representative of this kind of switch assembly. This switch assembly is provided with a first switch unit, a second switch unit, and a third switch unit, each having a control lever for allowing the corresponding switch to take ON and contact holder which have movable contacts and moves from an OFF position to an ON position in unison with the movement of the lever. In this switch assembly, when one of the switches is disposed at the ON position by operating the corresponding lever, the contact holder takes the ON position and is locked by a lock member in the switch case. Thus, the movable contact held by the contact holder contacts fixed contacts on a substrate in the switch case. The switch assembly is further provided with a special release lever for turning off all the switches. When the release lever is operated, the contact holders at the ON positions are released from the lock member so that the contact holders together with the control lever return to the OFF positions.

The above-described switch assembly has, however, a disadvantage in that a large switch case is required because it must house not only all the switch units, namely, the first, second, and third switch units, but also a special release lever.

SUMMARY OF THE INVENTION

Accordingly, it is an essential object of the present invention to provide an improved switch assembly in which the number of control levers is reduced by allowing the control lever for one switch unit to function as the release lever.

In accomplishing this and other objects, according to one preferred embodiment of the present invention, there is provided an improved switch assembly comprising a switch case; a plurality of switch units provided in the switch case, each of the switch units having control lever supported by the switch case so as to be pivotable between an ON position and OFF position, a contact holder which is operated by the control lever so as slide between an ON position and an OFF position in the switch case, and a spring for urging the contact holder toward the OFF position, the control lever of a first switch unit supported in the switch case so as to be pivotable to a lock release position located at a position opposite to the ON position relative to the OFF position; a lock member for holding each of the contact holders of the switch units at the ON positions when the contact holders reach the ON positions; a lock release member which slides from a normal position to a lock release position, at which the contact holder is released from the lock member, when the control lever of the first switch unit is operated to be moved from the ON position or the OFF position to the lock release position; and a spring for urging the lock release member toward the normal position.

In the above construction, each contact holder is moved from the OFF position to the ON position by rotating the control lever of the corresponding switch unit from the OFF position to the ON position, so that the switch unit is turned on. When the control lever of the first switch unit is pivoted from the OFF position or ON position to the lock release position, the lock release slide member is moved from a normal position to the lock release position at which the contact holder is released from the lock member so as to return the contact holder to the OFF position by the urging force of the spring.

The following advantages can be obtained by the above-described construction according to the present invention. The control lever of one of at least two switch units, namely, the control lever of the first switch unit is movable to the OFF position, ON position, and the lock release position at which the contact holders of all the switch units are returned from the ON position to the OFF position. That is to say, the control lever of the first switch unit is allowed to function as an operation member of the first switch unit and a release member for turning off all the switch units. Accordingly, it is unnecessary to provide a special release lever for only turning off the all switch units. Therefore, the switch case can be compact, and the space in the periphery of the switch assembly can be effectively utilized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

This and other objects and features of the present invention will become apparent from the following description taken in conjunction with the preferred embodiment thereof with reference to the accompanying drawings which are given by way of illustration only, and thus, are not limitative of the present invention, and in which.

DETAILED DESCRIPTION OF THE INVENTION

A preferred embodiment of the present invention is described with reference to FIGS. 1 through 4.

A switch assembly embodying the present invention is applied to the wiper control device of an automobile.

Figure 1:
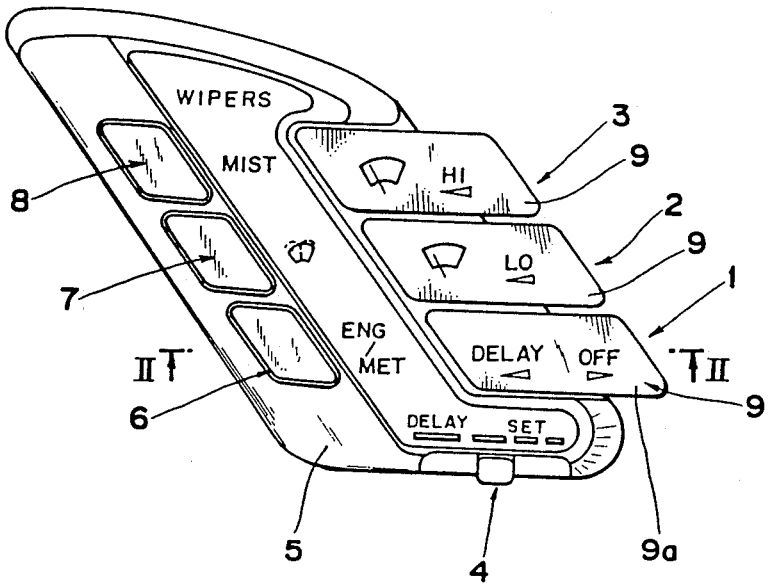
FIG. 1 is a front view of a switch assembly according to an embodiment of the present invention applied to a wiper control device in use for an automobile.
Figure 2:
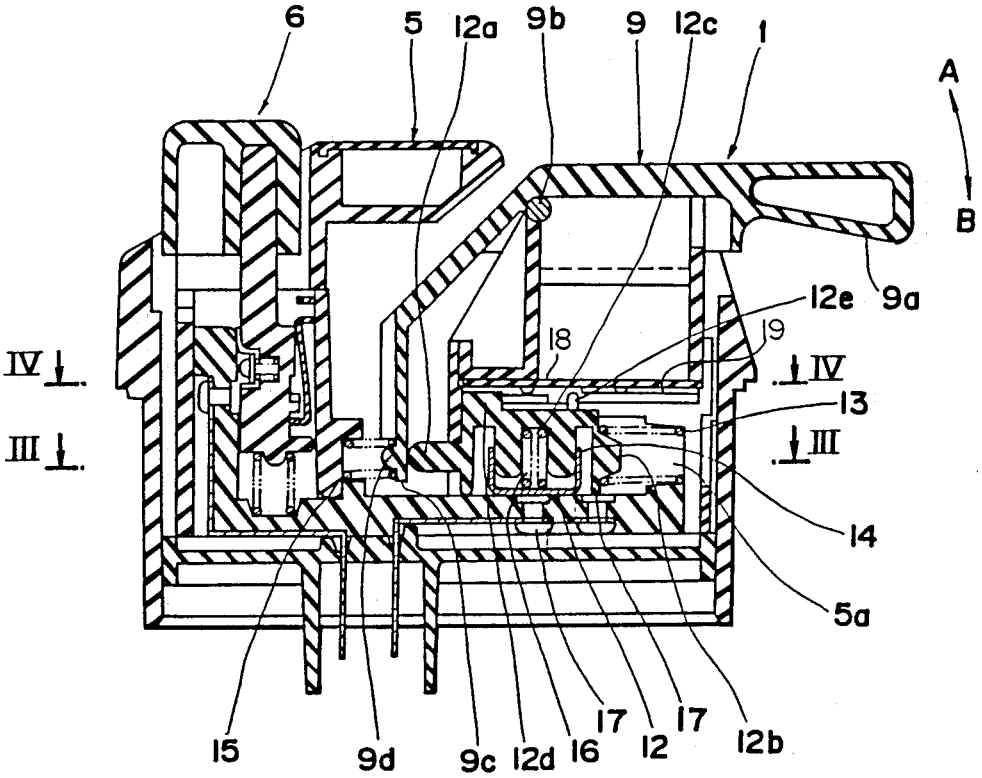
FIG. 2 is a sectional view taken along a line II—II in FIG. 1.

Referring to FIGS. 1 and 2, a switch assembly in accordance with the present invention essentially comprises a first switch unit 1 having a function of intermittently operating a wiper, a second switch unit 2 for operating the wiper t a low speed, and a third switch unit 3 for operating the wiper at a high speed. The switch units 1, 2 and 3 are arranged in a row in a switch case 5. A contact holder 12 interlocked with a control lever 9 is moved by pulling the knob 9a of the lever 9 of the corresponding switch unit 1, 2 or 3 to the ON position, na in the direction (A) as indicated by an arrow in FIG. 2. This results in a movable contact 14 mounted on the contact holder 12 being brought into contact with a contact 17 fixed to the switch case 5 and the lever of other switch unit cannot be operated simultaneously. Referring to FIG. 1, the switch assembly further comprises a delay set knob 4 for adjusting the interval of the movement of the wiper which is operated when a first switch unit 1 is turned on by operating the lever 9, a change-over button 6 for allowing a speed meter to make either a "meter" indication or a "mile" indication, a button 7 for spraying washing water on a front window, and a button 8 for moving the wiper only once to wipe mist which has adhered to the front window while a vehicle is traveling.

Each of the switch units comprises the lever 9 rotatably mounted on the switch case 5 and the contact holder 12 to be moved by rotating the lever 9 so as to bring the movable contact 14 into contact with contacts 17, 17 fixed to the switch case 5.

The substantially V-shaped lever 9 comprises a knob 9a formed on one end thereof extending from approximately the bent center thereof in the direction remote from at the switch case 5, projections 9b, 9b formed approximately at the center of the lever 9 and extending in both sides from its center in the direction in which the switch units 1, 2 and 3 are arranged, an inner end 9c extending toward the inside of the switch case 5 and disposed at a position opposite to the knob 9a, and a sectionally semi-spherical projection 9d formed on the inner end 9c and confronting the buttons 6, 7 and 8, namely in the left in FIG. 2. The inner end 9c of the lever 9 is pivoted about the projections 9b, 9b inside the switch case 5 when the knob 9a of the lever 9 is operated. A spring 15 disposed between the projection 9d and an inner surface of the switch case 5 allows the lever 9 to move to the OFF position but urges inner end 9c toward the right-hand side of FIG. 2.

A chamber 5a is defined inside the switch case 5 below the lever 9a, as shown in FIG. 2, and the contact holder 12 is slidably movable along the inner surface of the chamber 5a in the longitudinal direction of the switch knob 9a. The contact holder 12, which is substantially rectangular, has a projection 12a at front end thereof extending out of the chamber 5a toward the button 6, 7 or 8 and a projection 12b in the shape of a truncated cone extending from the rear end face thereof. A spring 13 for urging the contact holder 12 toward the OFF position is mounted between the projection 12b and an inner face of the chamber 5a, whereby the various contact holdup 12 are urged toward the respirator buttons 6, 7 or 8. The contact holders 12 have two or three recesses 12c, 12c on the lower faces thereof and the U-shaped movable contacts 14 are disposed below the recess 12c, respectively. A spring 16 mounted in the recess 12c urges the movable contact 14 downwardly, namely, toward the bottom face of the switch case 5. A pair of the contacts 17, 17 are fixed on the insulating material of the bottom face of the chamber 5a, on which the contact holder 12 slides so that the contacts 17, 17 may communicate with each other through the movable contact 14. Thus, when the knob 9a of the lever 9 of one of the switch units 1, 2 and 3 is pulled, the inner end 9c of the lever 9 presses the projection 12a of the corresponding contact holder 12 against the urging force of the spring 13 toward the ON position, thus allowing the contact holder 12 to slide. As a result, a pair of the contacts 17, 17 engage the movable contact 14. The contact holder 12 is capable of moving until projection 12b contacts the inner face of the chamber 5a. In addition, an engage projection 12e and a restriction projection 12d are formed on the upper face of the contact holder 12.

Figure 3:
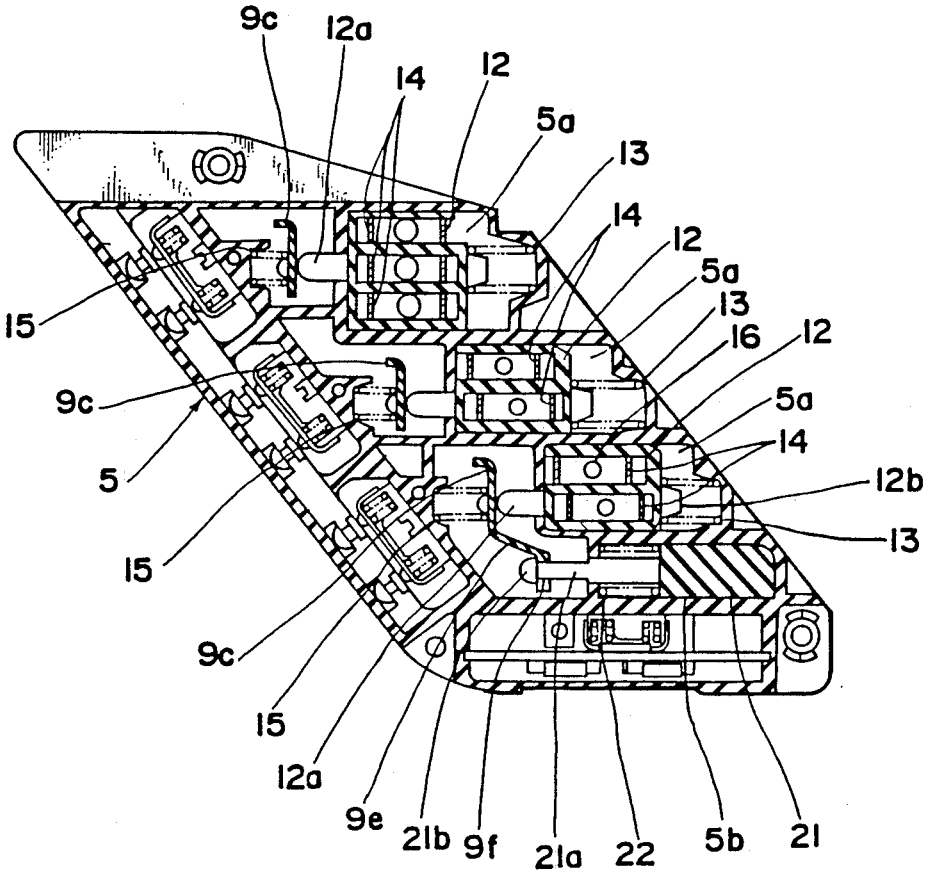
FIG. 3 is a sectional view taken along a line III—III in FIG. 2.

As shown in FIG. 3, a second chamber 5b is defined in the switch case 5 on the side opposite to the second switch unit 2 with respect to the first chamber 5a of the first switch unit 1. A lock release slide member 21 is provided in the second chamber 5b so as to be movable between a normal position and a lock release position. The lock release slide member 21 has a projection 21a forwardly projecting from the end thereof and the projection 21a is coupled with a spring 22 so that the slide member 21 is urged toward the normal position opposite to the button 6. The projection 21a projecting out of the chamber 5b is slidably inserted through an opening 9f formed in a connection end 9e extending from the inner end 9c of the lever 9 of the first switch unit 1. A head 21b is formed on the tip of the projection 21a. Accordingly, when the knob 9a of the lever 9 of the first switch unit 1 is pulled, the end 9c of the lever 9 presses down the contact holder 12 of the first switch unit 1, but does not press the lock release slide- member 21, Thus, the contact holder 12 moves in the chamber 5a. At this time, the connection end 9e of the lever 9 slides along the projection 21a of the lock release slide member 21. When the lever 9 of the first switch 1 is depressed, the inner end 9c of the lever 9 moves toward the buttons 6, 7 and 8. At this time, since the connection end 9e engages the head 21b of the lock release slide member 21, the member 21 is moved toward the buttons 6, 7 and 8. As a result, the lock release slide member 21 moves from the normal position toward the lock release position against the urging force of the spring 22.

Figure 4:
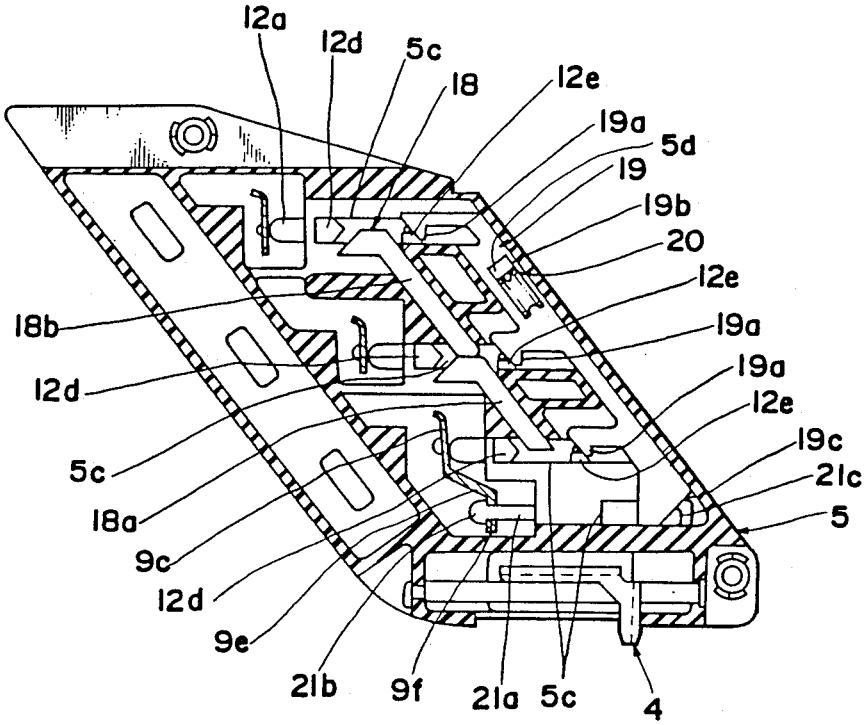
FIG. 4 is a sectional view taken along a line IV—IV in FIG. 2.

As shown in FIG. 4, slits 5c are formed in the upper walls of the chambers 5a and 5b. A plate-shaped lock member 19 and a plate-shaped restriction member 18 traverse in a space above the upper walls of the chambers 5a and 5b. Locking projections 19a formed on the lock member 19 are provided for the respective levers 9. When the projections 12e extending upwardly through the slits 5c are locked by the locking projections 19a, the contact holder 12 is held at the ON position. The lever 9 is maintained at the ON position by the return spring 15. The locking member 19 has a through hole 19b in which a projection 5d supported by the switch case 5 extends. A spring 20 is mounted in the through hole 19b between the inner face of the through hole 19b and a face of the projection 5d, so as to press the locking member 19 so that the engaging of the locking projection 19a and the engage projection 12e is maintained.

The restriction member 18 comprises a pair of restriction plates 18a, 18b. The restriction plate 18a extends over the chambers 5a of the first and second switch units 1, 2 parallel to the lock member 19 and the restriction plate 18b extends over the chambers 5a of the second and third switch units 2, 3 in parallel to the lock member 19. The restriction plates 18a, 18b are movable in the space above the slits 5c along inner faces of the switch case 5. One end of the restriction plate 18a is disposed above the slit 5c over the chamber 5a of the first switch unit 1 and the other end thereof is disposed above the slit 5c over the chamber 5a of the second switch unit 2. One end of the restriction plate 18b is disposed above the slit 5c over the chamber 5a of the second switch unit 2 and the other inner end thereof is disposed above the slit 5c over the chamber 5a of the third switch 3. Accordingly, when the lever 9 is operated, the restriction projection 12d of the contact holder 12 moves along the slit 5c. When the side confronting the restriction member 18 contacts the end face of the restriction plate 18a or 18b, the restriction plate 18a or 18b is forced to move in the longitudinal direction thereof. Therefore, even if the levers of the other switch units are operated, the restriction plate 18a or 18b prevents the corresponding restriction projections 12d from moving along the slits 5c, that the other levers 9 are not rotated to the ON positions.

Formed on the upper face of the lock release slide member 21 is a lock release projection 21c disposed in the vicinity of one end of the lock member 19. When the lock release slide member 21 moves toward the button 6, the inclined face of the lock release projection 21c slidably contacts the inclined end face 19c of the lock member 19, with the result that the lock member 19 is forced to move upwards in FIG. 4 against the urging force of the spring 20, and the engage projection 12e of the contact holder 12 is released from the locking projection 19a of the lock member 19.

According to the above-described construction when the lever 9 of the first switch unit 1 is pivoted in the direction indicated by the arrow (A) in FIG. 2, the inner end 9c of the lever 9 presses the projection 12a of the contact holder 12 toward the right in FIG. 2. As a result, the contact holder 12 is moved from the OFF position toward the ON position against the urging force of the spring 13. At this time, the restriction projection 12d of the contact holder 12 engages an end of the restriction plate 18a. As a result, the restriction plate 18a and the restriction plate 18b are moved upwards in FIG. 4, whereby the restriction projection 12d of the contact holders 12 of the other switch units are not allowed to move along the slits 5c toward the lock member 19, for example the other switch units 2, 3 are not turned on simultaneously with the first switch unit 1. When the projection 12e of the contact holder 12 is locked by the locking projection 19a of the lock member 19 as a result of the movement of the contact holder 12 toward the ON position, the contact holder 12 is held at the ON position. The movable contact 14 of the contact holder 12 engages the contacts 17, 17 mounted in the switch case 5 when the contact holder 12 is at the ON position, whereby the wiper is intermittently operated. In this state, the lever 9 is maintained at the ON position by the urging force of the spring 15. Thus, when the contact holder 12 moves from the OFF position to the ON position, the connection end 9e of the lever 9 slides along the protection 21a of the lock release slide member 21, for example, it does not press the lock release slide member 21.

When the knob 9a of the lever 9 of the second switch unit 2 is pulled under such a condition that the first switch unit 1 is ON, the projection 12e of the second switch unit 2 pushes up the locking projection 19a so that the projection 12e of the first switch unit 1 is released from the corresponding locking projection 19a, resulting in the first switch unit 1 being turned OFF, while the second switch unit 2 is turned ON.

When the second switch unit 2 or the third switch unit 3 is operated, a similar operation as described above is performed.

When the lever 9 of the second switch unit 2 is operated to move the corresponding contact holder 12 from the OFF position to the ON position, the restriction plates 18a, 18b are moved in different directions, namely, upwards and downwards by the inclined faces of the restriction projection 12d confronting the restriction member 18. Thus, the rotation of the levers of the first or third switch units 2 or 3 for example, the movements of the corresponding contact holders 12 from the OFF position toward the ON position are restricted.

When the knob 9a of the lever 9 of the first switch unit 1 is pressed down in a direction indicated by an arrow (B) in FIG. 2, the lock release slide member 21 is moved toward the button 6 against the urging force of the spring 22. As a result, the lock release projection 21a of the lock release slide member 21 moves the lock member 19 upwards in FIG. 4, and the projection 12e of the contact holder 12 which has been locked by the locking projection 19a of the lock member 19 is released, and the contact holder 12 is returned to the OFF position by the urging force of the spring 13, whereby the wiper is stopped. When the lever 9 is released immediately after it is pressed down, the lock release slide member 21 returns from the lock release position to the OFF position by the urging force of the spring 22 and the lever 9 returns to the OFF position by the spring 15.

According to the above embodiment, the wiper can be operated by pulling up the knob 9a of the lever 9 of the first switch unit 1. When the lever 9 is pressed down, the contact holder 12 is released from the lock member 19. Thus, the lever 9 returns from the ON position to the OFF position, whereby the wiper can be stopped. Accordingly, it is unnecessary to provide a special release lever for only turning off the first, second and third switch units 1, 2 and 3, so that a space for housing the switch assembly can be reduced, for example a space in the periphery of the switch assembly is effectively utilized. When the knob 9a of the lever of the first switch unit 1 is pivotal, the inner end 9c of the lever 9 moves the contact holder 12 to the ON position and the lock release slide member 21 is not moved at this time. Therefore, the wiper can be reliably operated. When the knob 9a of the lever 9 of the first switch unit 1 is depressed, the inner end 9c of the lever 9 moves apart from the projection 12a of the contact holder 12 and the connection end 9e moves the lock release slide member 21 toward the button 6, whereby the other two contact holder can be reliably released from the lock member 19. Accordingly, when the first switch unit 1 is operated, no troubles occur in performing other operations smoothly.

The present invention is not limited to the above embodiment, namely, to a wiper device, but can be utilized in various apparatuses. For example, the switch assembly can be utilized for an illumination apparatus in use for an automobile. The switch assemblies can be applied to apparatuses having ON and OFF switches. The number of switch units may be two or more than three.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switch assembly comprising:

a switch case;

a plurality of switch units provided in said switch case, each of said switch units having a control lever supported by said switch case for pivoting between an ON position and an OFF position, a contact holder which is operated by said lever for sliding between an ON position and an OFF position in said switch case, and a spring for urging said contact holder toward the OFF position, the control lever of a first switch unit supported in said switch case being pivotable to a lock release position located at a position opposite to the ON position relative to the OFF position;

a lock member for holding each of said contact holders of said switch units at the ON position, only one of said contact holders being positionable in the ON position at one time;

restriction means for limiting the movement of the contact holders whereby only one contact holder can move to the ON position at one time;

a lock release member positioned within said switch case for cooperation with said contact holders, said lock release member slides from a normal position to a lock release position, whereat said contact holder is released from said lock member, when said control lever of said first switch is pivoted to move from the ON position or the OFF position to the lock release position; and a spring for urging said lock release member toward the normal position.

2. The switch assembly as claimed in claim 1, wherein said control lever of said first switch unit has an operation end for operating said contact holder and said lock release member, and said lock release member has a projection which extends through a through hole formed on said operation end, said projection having a tip end which is engageable with said operation end of said control lever;

said operation end of said first switch unit slides along said projection of said lock release member located at the normal when said control lever is pivoted from the OFF position to the ON position, while said lock release member is moved from the normal position to the lock release position by said operation end of said operation lever engaged by a lock portion of said projection of said lock release member when said operation lever is pivoted from the ON position or OFF position to the lock release position.

* * * * *